US010900336B2

(12) United States Patent
Hrupp et al.

(10) Patent No.: US 10,900,336 B2
(45) **Date of Patent: *Jan. 26, 2021**

(54) MECHANICAL PERFORATOR WITH GUIDE SKATES

(71) Applicant: Exacta-Frac Energy Services, Inc., Conroe, TX (US)

(72) Inventors: Joze John Hrupp, Montgomery, TX (US); Lloyd Murray Dallas, Streetman, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 143 days.

This patent is subject to a terminal disclaimer.

(21) Appl. No.: 16/149,319

(22) Filed: Oct. 2, 2018

(65) Prior Publication Data

US 2020/0102815 A1 Apr. 2, 2020

(51) Int. Cl.

*E21B 43/119* (2006.01)
*E21B 23/00* (2006.01)
*E21B 17/10* (2006.01)

(52) U.S. Cl.

CPC ..... *E21B 43/119* (2013.01); *E21B 17/1078* (2013.01); *E21B 23/00* (2013.01)

(58) Field of Classification Search

CPC ..... E21B 29/00; E21B 29/005; E21B 43/112; E21B 43/11855; E21B 43/119; E21B 23/02

See application file for complete search history.

(56) References Cited

U.S. PATENT DOCUMENTS 1,433,722 A * 10/1922 Hinderliter ..... E21B 29/00 166/55.2
1,731,553 A * 10/1929 Van Keulen ..... E21B 29/00 166/55.2
1,776,025 A * 9/1930 Hinderliter ..... E21B 29/00 166/55.2
1,779,652 A 10/1930 Wood
1,786,590 A 12/1930 Althausen
1,789,993 A 1/1931 Switzer
2,019,450 A 8/1936 Johnson
2,322,695 A * 6/1943 Kinzbach ..... B23B 5/162 166/55.8
2,328,782 A 9/1943 Bynum
2,525,007 A 10/1950 Worden et al.
2,705,998 A * 4/1955 Spang ..... E21B 29/00 166/55.3
2,725,936 A 12/1955 Hester
2,741,316 A * 4/1956 Long ..... E21B 47/09 166/63
2,743,906 A 5/1956 Coyle (Continued)

FOREIGN PATENT DOCUMENTS

CA 2842568 A1 * 5/2014 ..... E21B 31/00
WO WO-2015073011 A1 * 5/2015 ..... E21B 43/112

*Primary Examiner* — Jennifer H Gay

(74) *Attorney, Agent, or Firm* — J. Bennett Mullinax, LLC

(57) ABSTRACT

A mechanical perforator with guide skates includes a perforator module and a skate module. The perforator module has perforator blades that may be forced outwardly to perforate machined-away areas of a well casing after the skate module has guided the perforator blades into alignment with the respective machined-away areas and locked the perforator blades in that alignment.

15 Claims, 9 Drawing Sheets

(56) References Cited

U.S. PATENT DOCUMENTS 2,746,550 A * 5/1956 Mitchell, Jr. ..... E21B 19/00 166/255.1
2,753,935 A * 7/1956 Fredd ..... E21B 43/112 166/55.2
2,859,943 A 11/1958 Chadderdon
2,999,542 A * 9/1961 Myers ..... E21B 47/09 166/64
3,211,221 A 10/1965 Huitt
3,331,439 A 7/1967 Sanford
3,344,862 A * 10/1967 Conrad ..... E21B 29/00 166/216
3,366,179 A * 1/1968 Kinley ..... E21B 43/11855 166/55.3
3,419,077 A 12/1968 Sanford
3,447,604 A * 6/1969 Anderson ..... E21B 43/11855 166/63
3,468,386 A * 9/1969 Johnson ..... E21B 43/117 175/4.6
4,068,711 A 1/1978 Aulenbacher
4,106,561 A 8/1978 Jerome et al.
4,165,784 A * 8/1979 Gardner ..... E21B 43/112 166/117.5
4,220,201 A 9/1980 Hauk
5,732,770 A 3/1998 Beeman
6,155,150 A 12/2000 Cooper et al.
6,772,938 B2 8/2004 Bond
7,581,591 B2 * 9/2009 Schwindt ..... B23D 11/00 166/298
7,740,059 B1 6/2010 Spencer
9,187,989 B2 11/2015 Lee
9,382,782 B2 7/2016 Pasvandi
9,598,939 B2 3/2017 Lee
9,611,725 B2 4/2017 Mlcak et al.
9,784,078 B2 10/2017 Holly et al.
2002/0144815 A1 * 10/2002 Van Drentham-Susman ..... E21B 23/04 166/241.1
2008/0178721 A1 * 7/2008 Schwindt ..... E21B 43/112 83/191
2010/0089583 A1 4/2010 Xu et al.
2012/0160516 A1 * 6/2012 Ravensbergen .... E21B 47/0905 166/380
2015/0101812 A1 * 4/2015 Bansal ..... E21B 29/002 166/298
2015/0300135 A1 * 10/2015 Micak ..... E21B 43/119 166/298
2016/0138369 A1 * 5/2016 Tunget ..... E21B 29/00 166/311
2016/0265294 A1 * 9/2016 Robertson ..... E21B 23/02
2016/0273293 A1 * 9/2016 Surjaatmadja ..... E21B 33/13
2018/0038221 A1 * 2/2018 Hughes ..... E21B 33/124
2018/0334881 A1 * 11/2018 Dallas ..... E21B 17/006
2019/0186224 A1 * 6/2019 Beazer ..... E21B 34/10
2019/0257177 A1 * 8/2019 Greci ..... E21B 29/005
2019/0323310 A1 * 10/2019 Robertson ..... E21B 23/01
2020/0102794 A1 * 4/2020 Dallas ..... E21B 17/006
2020/0102815 A1 * 4/2020 Hrupp ..... E21B 43/119
2020/0109613 A1 * 4/2020 Hrupp ..... E21B 23/01

* cited by examiner

MECHANICAL PERFORATOR WITH GUIDE SKATES

CROSS REFERENCE TO RELATED APPLICATIONS

This is the first application for this invention.

FIELD OF THE INVENTION

This invention relates in general to well casing perforators and, in particular, to a novel mechanical perforator with guide skates for use with mechanically perforated well casing collars used to assemble casing strings for lining hydrocarbon well bores.

BACKGROUND OF THE INVENTION

Well casing perforators are known in the art and are used to perforate a "casing string" that is inserted into a hydrocarbon well bore to provide a smooth liner in the well bore. Casing strings are typically assembled using lengths of plain pipe having pin-threaded ends called "casing joints", which are interconnected using short tubular "casing collars" that have complimentarily box-threaded ends, though the casing joints may be box-threaded and the casing collars may be pin-threaded. The casing string is usually "cemented in" after it is run into a drilled well bore by pumping a cement slurry down through and up around the outside of the casing string. The cement slurry sets around the casing string and inhibits fluid migration behind the casing within the wellbore. As is well understood in the art, once a casing string is cemented in the well bore, it provides a fluid-tight passage from the wellhead to a "toe" or bottom of the well. Consequently, the casing string must be perforated within any production zone(s) pierced by the well bore to permit hydrocarbon to flow from the production zone(s) into the casing string for production to the surface.

Known mechanical perforators are designed to perforate plain casing strings. Normally, selected casing joints in a production zone are perforated somewhere between adjacent casing collars in the casing string. Although many different designs for mechanical casing perforators have been invented, none of them have gained widespread commercial use. Considerable force is required to perforate plain casing joints, so mechanical perforators tend to deform an internal diameter of the casing joints while perforating them. This can complicate subsequent re-completion operations in the wellbore. Besides, the force required to perforate a plain casing joint tends to rapidly wear perforating parts of the mechanical perforators, which limits the duty cycle of those mechanical perforators.

Since well bores can now be bored to great depths where downhole fluid pressures are very high, and lateral well bores can be bored much longer than in the past, previously used casing perforators are no longer an economically viable option. Consequently, Applicant invented a novel casing collar that facilitates mechanical perforation and permits uninterrupted well completion in a lateral wellbore of any length that can be drilled and cased, as described in Applicant's co-filed United States patent application entitled Mechanically Perforated Well Casing Collar, the specification of which is incorporated herein by reference.

As understood by those skilled in the art, casing collars must be very sturdy to withstand the mechanical strain of holding together a long casing string while it is run through the inevitably corkscrew-shaped path of a very long lateral wellbore that may be ten thousand feet or more in length. As described in Applicant's above-referenced co-pending patent application, mechanical perforation of a casing collar can be facilitated by providing selected machined-away areas within a sidewall of the casing collar. While machining the casing collar to provide the machined-away areas in the casing collar sidewall is straightforward, locating those areas in the casing collar several thousand feet from the surface is not a trivial task. Consequently, a mechanical perforator for use with the novel casing collar that can reliably guide perforator blades of the mechanical perforator into alignment with the respective machined-away areas of the casing collar is desirable.

There therefore exists a need for a mechanical perforator with guide skates that can reliably guide perforator blades of the mechanical perforator into alignment with respective machined-away areas in a sidewall of a well casing collar expressly designed to be mechanically perforated.

SUMMARY OF THE INVENTION

It is therefore an object of the invention to provide a mechanical perforator with guide skates that can reliably guide perforator blades of the mechanical perforator into alignment with respective machined-away areas in a sidewall of a mechanically perforated casing collar.

The invention therefore provides a mechanical perforator comprising: at least one perforator blade adapted to mechanically perforate a well casing collar having a sidewall with at least one machined-away area to facilitate mechanical perforation of the well casing collar, a linear force generator connected to the at least one perforator blade to provide linear force to drive the at least one perforator blade through the respective machined-away areas of the sidewall; and, a skate module that guides the at least one perforator blade into alignment with at least one machined-away area and releasably locks the at least one perforator blade in alignment with the at least one machined-away area.

The invention further provides a mechanical perforator comprising: a perforator module having three perforator blades adapted to mechanically perforate a well casing; a linear force generator connected to one side of the perforator module to provide linear force to drive the three blades of the perforator module through a sidewall of the well casing; and, a skate module connected to an opposite side of the perforator module, the skate module guiding each of the three blades of the perforator module into alignment with respective ones of three machined-away areas of the sidewall of the well casing and releasably locking the three blades in respective alignment with the three machined-away areas of the sidewall.

The invention yet further provides a mechanical perforator comprising a perforator module and a guide skate module, the perforator module having a plurality of perforator blades respectively adapted to perforate a machined-away area of a well casing having an internal guide and lock structure adapted to cooperate with the guide skate module to guide the respective perforator blades into alignment with respective ones of the machined-away areas of the well casing and to releasably lock the perforator module in that alignment.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
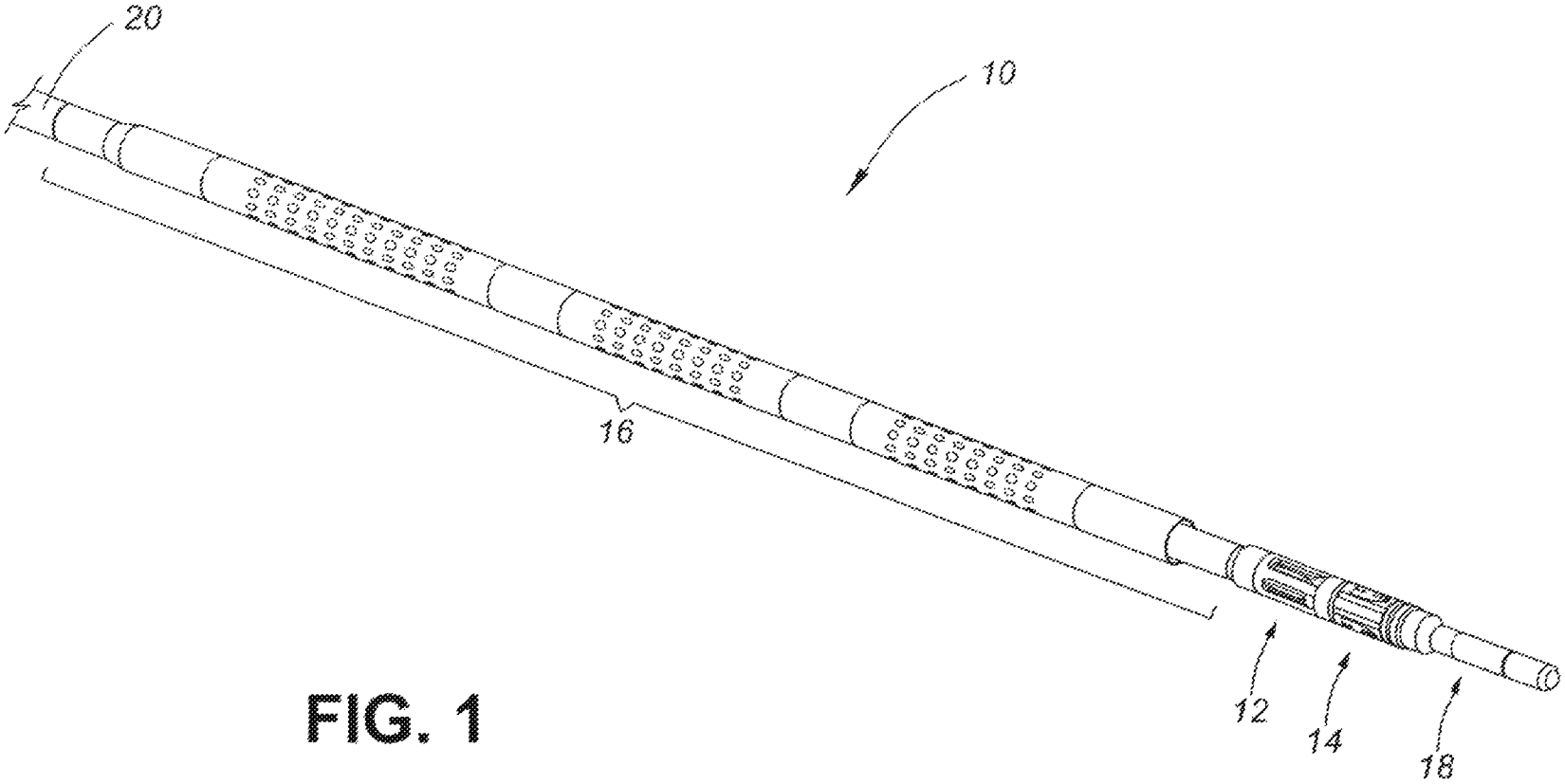
FIG. 1 is a perspective view of one embodiment of a mechanical perforator in accordance with the invention.

The invention provides a mechanical perforator with at least one perforator blade and at least one guide skate for use with mechanically perforated well casing collars in a casing string used to line a hydrocarbon well bore. The at least one guide skate guides the at least one perforator blade of the mechanical perforator into alignment with at least one machined-away area of a mechanically perforated well casing collar. The machined-away area(s) Is designed to facilitate mechanical perforation of the casing collar by the perforator blade(s). The guide skate(s) is normally urged to a retracted condition by springs, or the like. Fluid pressure pumped into the mechanical perforator moves the guide skate(s) to a deployed condition in which it is guided by a guide and lock structure within the mechanically perforated well casing collar to a lock recess in the well casing collar that retains the guide skate to lock the mechanical perforator in position for perforating the well casing collar. After the well casing collar is perforated and the perforator blade is retracted, pressure is released from the mechanical perforator, which returns the guide skate(s) to the retracted condition and the mechanical perforator can be moved downhole to permit fracturing fluid to be pumped down an annulus of the casing string and through the perforation(s) in the casing collar to stimulate a section of the production zone behind the casing string. This process may be repeated until the entire production zone has been fractured and the well bore is ready for production.

| Part No. | Part Description |
|---|---|
| 10 | Mechanical perforator |
| 12 | Perforator module |
| 14 | Skate module |
| 16 | Linear force generator |
| 17 | Linear force generator mandrel |
| 18 | Downhole tool termination components |
| 20 | Work string |
| 21 | Perforator body |
| 22 | Mechanically perforated casing collar |
| 23 | Pin-threaded upper end of perforator body |
| 24a-24c | Perforator blades |
| 25 | Perforator body slots |
| 26a-26c | Perforator blade holders |
| 28a | Perforator blade tracks |
| 30 | Perforator blade track end |
| 32 | Machined-away area |
| 34 | Upper perforator end cone |
| 35 | Perforator end cone ribs |
| 36 | Threaded connection |
| 38 | Lower perforator end cone |
| 39 | Cross-over sleeve |
| 40 | Crossover body |
| 42 | Transition sub |
| 44 | Transition sub thread connection |
| 46 | Crossover body mandrel |
| 48 | Velocity bypass sub |
| 50 | Velocity bypass valve |
| 52 | Velocity bypass valve spring |
| 54 | Velocity bypass valve ports |
| 56 | Velocity bypass choke |
| 68 | Terminal sub |
| 60 | Central passage |
| 62a-62c | Guide skates |
| 64 | Skate piston |
| 66 | Skate piston port |
| 68 | Skate piston chamber |
| 70 | T-slot |
| 72a, 72b | T-sliders |
| 74 | Skate wear buttons |
| 76 | Skate springs |
| 78 | Skate module body |
| 80a, 80b | Skate mandrel end Caps |
| 82a-82c | Skate cavities |
| 84a, 84b | Skate retainer rings |
| 86 | Skate retainer bars |
| 88a, 88b | Skate end bevels |
| 90a, 90b | Skate side arms |
| 92 | Skate spring sockets |
| 94 | Skate piston rod socket |
| 96 | Guide and lock structure |
| 98 | Annular shoulder |
| 100 | Guide point |
| 102 | Skate lock recess shoulder |
| 104 | Skate lock recess |

FIG. 1 is a perspective view of one embodiment of a mechanical perforator 10 in accordance with the invention. The mechanical perforator 10 includes a perforator module 12, which will be explained in detail below with reference to FIGS. 2-5*c*, 16 and 17. The perforator module 12 is connected to a skate module 14 on its downhole end, and to a linear force generator 16 on its uphole end. The skate module 14 guides the perforator module 12 into an optimal position for perforating a mechanically perforated casing collar 22 (see FIG. 2) and locks the mechanical perforator 10 in that position. The skate module 14 will be explained below with reference to FIGS. 6-15. The linear force generator 16 provides linear force required to power the perforator module 12. The linear force generator 16 may be, for example, either one of the modular force multipliers described in Applicant's co-pending United States patent applications, the specifications of which are respectively incorporated herein by reference, namely: U.S. patent application Ser. No. 16/004,771 filed May 11, 2018 entitled "Modular Force Multiplier For Downhole Tools"; and, U.S. patent application Ser. No. 15/980,992 filed May 16, 2018 and also entitled "Modular Force Multiplier For Downhole Tools". Other prior art linear force generators may also be used, provided that they are capable of generating adequate linear force by converting pumped fluid pressure into linear force, or translating work string pull or work string push force push into the linear force required to power the perforator module 12.

Connected to a downhole end of the skate module 14 are downhole tool termination components 18, the function of which will be explained below with reference to FIG. 2. Connected to an uphole end of the liner force generator 16 is a work string 20, which may be a coil tubing work string or jointed tubing work string, depending on operator choice and a length of the well bore. As understood by those skilled in the art, coil tubing work strings have a shorter "push reach" than most jointed tubing work strings. The work string 20 is used to push the mechanical perforator 10 into a well bore, manipulate a position of the mechanical perforator 10 within the well bore and operate the linear force generator 16, as required.

Figure 2:
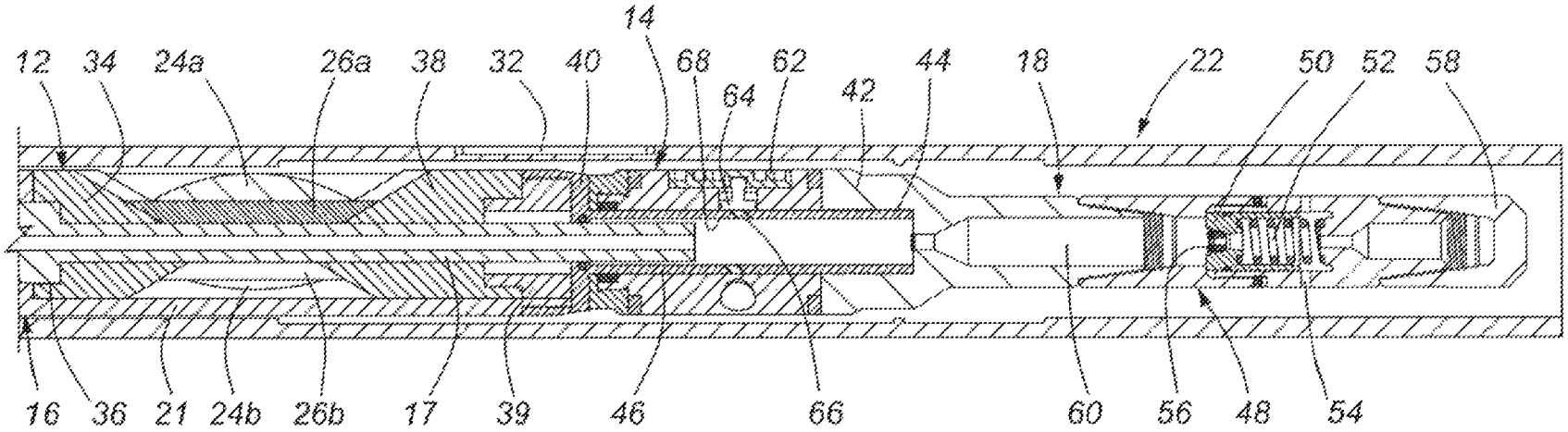
FIG. 2 is a cross-sectional view of a downhole end of the mechanical perforator shown in FIG. 1, inserted into Applicant's mechanically perforated well casing collar.

FIG. 2 is a cross-sectional view of a downhole end of the mechanical perforator 10 shown in FIG. 1, after insertion into a mechanically perforated casing collar 22 described in Applicant's co-filed United States patent application entitled "Mechanically Perforated Well Casing Collar", the specification of which has been incorporated herein by reference. In this embodiment, the perforator module 12 has three perforator blades 24*a*-24*c* (only 24*a* and 24*b* can be seen in this view), as will be described below in more detail. It should be understood that the term "perforator blade" as used in this document does not mean an instrument with a sharp cutting edge, though an instrument with a sharp cutting edge is not excluded. Rather, perforator blade means an instrument designed to repeatedly penetrate a machined-away area 32 of the casing collar 22 specifically machined to facilitate penetration of a sidewall of the casing collar 22. In this exemplary embodiment, the perforator blades 24*a*-24*c* are arcuate wedge-shaped instruments constructed of wear resistant metal. The outer edge of each perforator blade 24*a*-24*c* may optionally be coated, studded, or imbedded with diamond, carbide or like wear-resistant material to improve wear resistance and prolong a duty cycle of the perforator blades 24*a*-24*c*.

As will be explained below in more detail, each perforator blade 24*a*-24*c* is removably received in a respective perforator blade track 28*a* (see FIG. 4*c*) of respective blade holders 26*a*, 26*b*, 26*c*. The respective blade holders 26*a*-26*c* are connected to and reciprocate from a retracted position shown to a deployed position (see FIG. 17), on an upper perforator end cone 34 and a lower perforator end cone 38, as will be explained below in more detail. The respective upper perforator end cone 34 and lower perforator end cone 38 are surrounded and supported by a perforator body 21 (better seen in FIG. 3), which stabilizes the respective perforator end cones 34, 38 and prevents premature deployment of the perforator blades 24*a*-24*c*. The upper perforator end cone 34 is connected by a threaded connection 36 to a liner force generator mandrel 17 of the linear force generator 16. The lower perforator end cone 38 is supported on a free end of the linear force generator mandrel 17 and a crossover sleeve 39. The crossover sleeve 39 is shaped to provide support to a downhole end of the perforator body 21. The downhole end of the perforator body 21 is threadedly connected to a crossover body 40 having a crossover body mandrel 46 that supports the skate module 14. A downhole end of the crossover body mandrel 46 is threadedly connected to a transition sub 42 of the downhole tool termination components 18 by a transition sub thread connection 44.

In this embodiment, the downhole tool termination components 18 include the transition sub 42 and a velocity bypass sub 48. The velocity bypass sub 48 controls fluid flow through a central passage 60 of the mechanical perforator 10, which in turn controls a disposition of guide skates 62 of the skate module 14, as will be explained below in more detail with reference to FIGS. 6-15. The velocity bypass sub 48 includes a velocity bypass valve 50, which is normally urged to an open condition by a velocity bypass spring 52, which lets fluid pumped into the central passage 60 flow through a replaceable velocity bypass choke 56 and out through velocity bypass ports 54 into an annulus of the casing collar 22. When a rate of flow through the central passage 60 surpasses a threshold determined by a size of an orifice in the replaceable velocity bypass choke 56, the velocity bypass valve is forced to a closed condition in which it obstructs the velocity bypass ports 54 and stops fluid flow through the central passage 60. Fluid pressure then builds in the central passage 60, which forces fluid through skate piston port 66 and into skate piston chamber 68, urging skate piston 64 and connected guide skate 62 outwardly against an inner sidewall of the casing collar 22, the purpose of which will be explained below in more detail with reference to FIG. 16. A terminal sub 58 caps a lower end of the velocity bypass sub 48.

Figure 3:
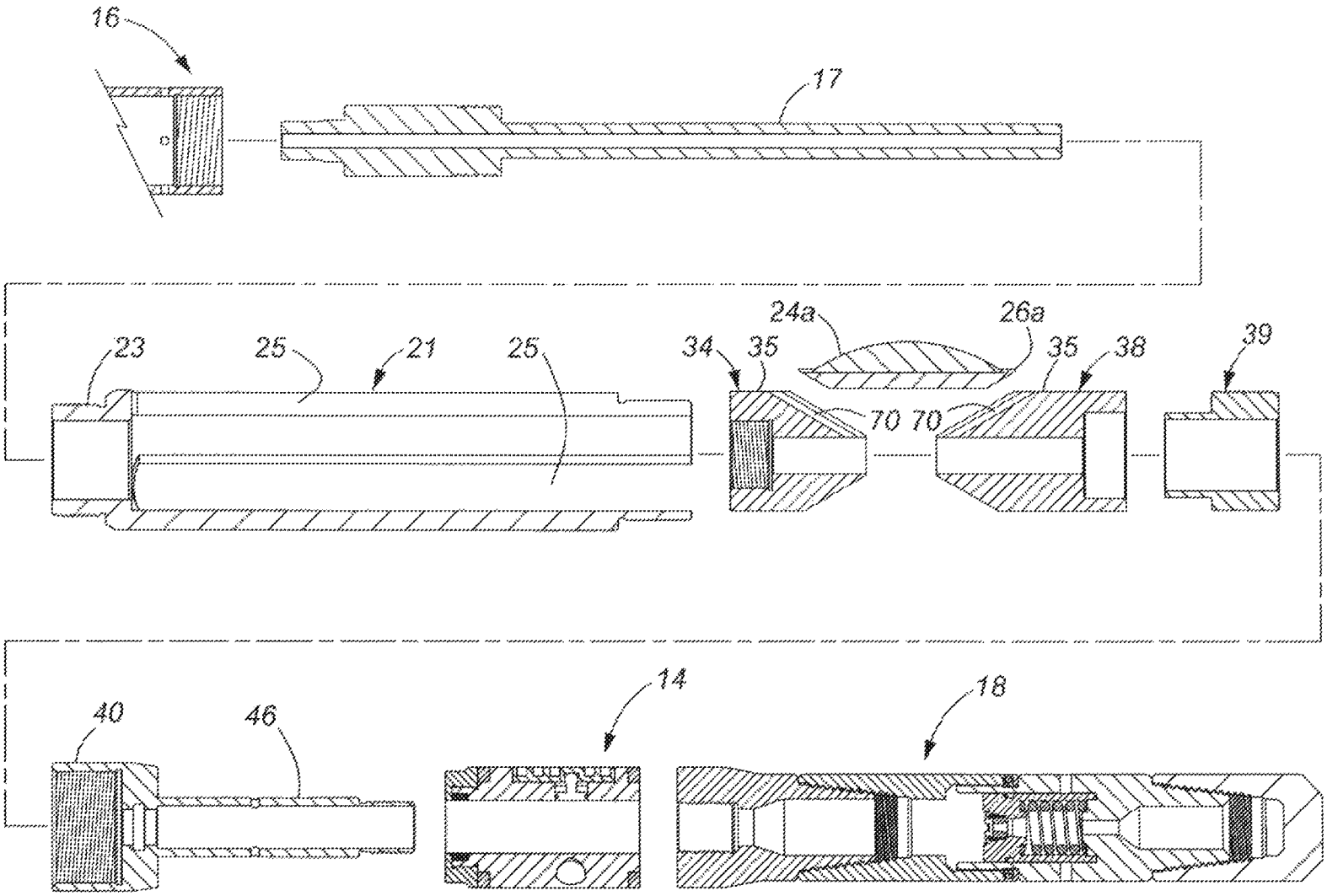
FIG. 3 is an exploded cross-sectional view of a perforator module of the mechanical perforator shown in FIG. 2.

FIG. 3 is an exploded cross-sectional view of the perforator module 12 of the mechanical perforator 10 shown in FIG. 2. The linear force generator 16 is threadedly connected to a pin-threaded upper end 23 of the perforator body 21. The respective upper end cone 34 and lower end cone 38 have end cone ribs 35 (better seen in FIG. 5*c*) that are respectively received in respective slots 25 in the perforator body 21. The slots 25 in the perforator body 21 permit the upper end cone 34 to reciprocate within the perforator body 21, as will be explained below with reference to FIGS. 16 and 17. The respective blade holders 26*a*-26*c* have T-sliders 72*a*, 72*b* (see FIGS. 4*a* and 4*c*) that are respectively received in T-slots 70 in the respective end cones 34 and 38. The lower end of the crossover sleeve 39 is shaped to support a lower end of the perforator body 21, which is threadedly connected to the crossover body 40, having the crossover body mandrel 46 that supports the skate module 14. The downhole tool termination components 18 are threadedly connected to the lower end of the cross-over body mandrel 46, as explained above.

Figure 4A:
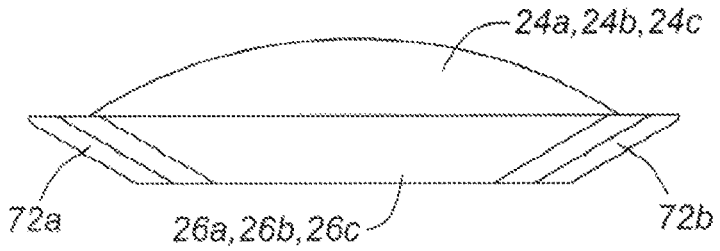
FIG. 4*a* is a side elevational view of a blade holder and perforator blade of the perforator module shown in FIG. 3.
Figure 4B:
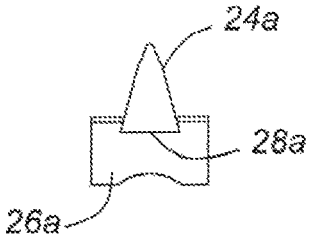
FIG. 4*b* is an end view of the blade holder and perforator blade of the perforator module shown in FIG. 4*a;*

FIG. 4*a* is a side elevational view of the blade holders 26*a*, 26*b* and 26*c* and the perforator blades 24*a*, 24*b* and 24*c* of the perforator module 12 shown in FIG. 3, and FIG. 4*b* is an end view of the blade holder 26*a* and perforator blade 24*a* of the perforator module 12 shown in FIG. 3.

Figure 4C:
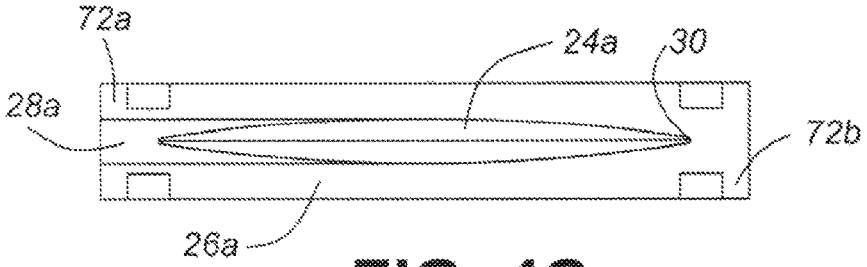
FIG. 4*c* is a top plan view of the blade holder and perforator blade of the perforator module shown in FIG. 4*a;*

FIG. 4*c* is a top plan view of the blade holder 26*a* and the perforator blade 24*a* of the perforator module 12. Each perforator blade holder 26*a*-26*c* has a perforator blade track 28*a* that removably receives the respective perforator blades 24*a*-24*c*, which permit the perforator blades 24*a*-24*c* to be replaced as required. The respective perforator blade tracks 28*a* have a respective perforator blade track ends 30. In this embodiment, the perforator blade track end 30 is curved to conform to the contour of the perforator blade 24*a*, but this is a matter of design choice.

Figure 5A:
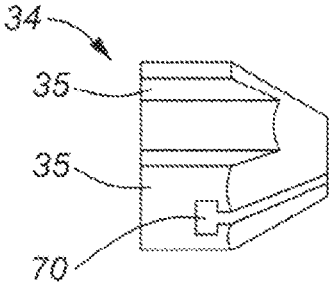
FIG. 5*a* is a side-elevational view of a perforator end cone shown in FIG. 3.

FIG. 5*a* is a side-elevational view of the upper perforator end cone 34 shown in FIG. 3. As explained above, each perforator end cone has ribs 35 received in the respective slots 25 of the perforator body 21. In this embodiment, each end cone 34, 38 has three ribs 35 and each rib 35 includes a T-slot 70 that receives a respective T-slider 72 of the respective blade holders 26*a*-26*c*, as described above. The lower perforator end cone 38 has the same configuration.

Figure 5B:
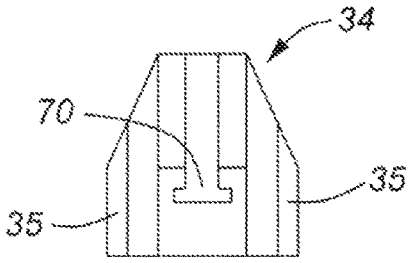
FIG. 5*b* is a top plan view of the perforator end cone shown in FIG. 5*a;*
Figure 5C:
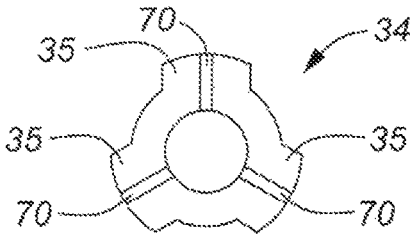
FIG. 5*c* is an end view of the end cone shown in FIG. 5*a;*

FIG. 5*b* is a top plan view of the perforator end cone 34 shown in FIG. 5*a*, and FIG. 5*c* is an inner end view of the perforator end cones 34, 38 shown in FIG. 3.

Figure 6:
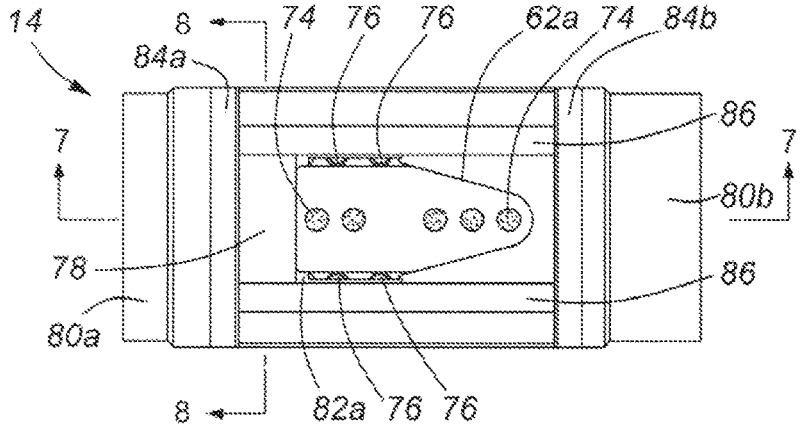
FIG. 6 is side elevational view of a skate module of the mechanical perforator shown in FIG. 2, with guide skates in a retracted condition.

FIG. 6 is side elevational view of the skate module 14 of the mechanical perforator 10 shown in FIG. 2, with the guide skates 62*a*-62*c* in a retracted condition, in which the mechanical perforator is run into the well bore or moved any considerable distance within the well bore. In this embodiment the skate module 14 includes three guide skates 62*a*-62*c*, though this is a matter of design choice within design limits understood by those skilled in the art. In this embodiment, each guide skate 62*a*-62*c* is provided with a plurality of skate wear buttons 74, which may be, for example, carbide buttons, industrial diamond buttons, ceramic buttons, or composite or ceramic buttons containing an embedded wear resistant material such as carbide or diamond particles, or the like. The skate module 14 includes a skate module body 78. An outer surface of the skate module body 78 is machined to include a skate cavity 82*a*-82*c* (see FIG. 9) for each guide skate 62*a*-62*c*. The respective skate cavities 82*a*-82*c* also house a pair of skate retainer bars 86 that flank opposed sides of each guide skate 62*a*-62*c*. The skate retainer bars 86 retain the respective guide skates 62*a*-62*c* in their respective skate cavities. In this embodiment, skate springs 76 located between the skate retainer bars 86 and the guide skates 62*a*-62*c* urge the guide skates 62*a*-62*c* to the retracted position. Fluid pressure in the central passage 60 (see FIG. 2) controls the disposition of the guide skates 62*a*-62*c*. As explained above, skate piston ports 66 provide fluid communication between the central passage 60 and the respective skate piston chambers 68, which respectively house skate pistons 64. The skate retainer bars 86 have opposed ends respectively captured by skate retainer rings 84*a*, 84*b*. The skate retainer rings 84*a*, 84*b* are retained on opposed ends of the skate module body 78 by respective skate mandrel end caps 80*a*, 80*b* that threadedly engage the opposed ends of the skate module body 78.

Figure 7:
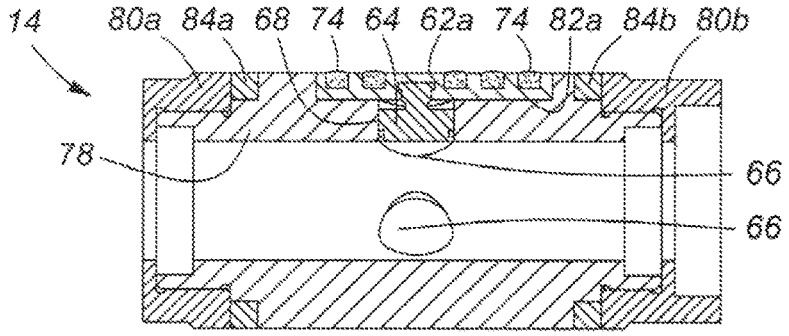
FIG. 7 is a cross-sectional view taken along lines 7-7 of the skate module shown in FIG. 6.
Figure 8:
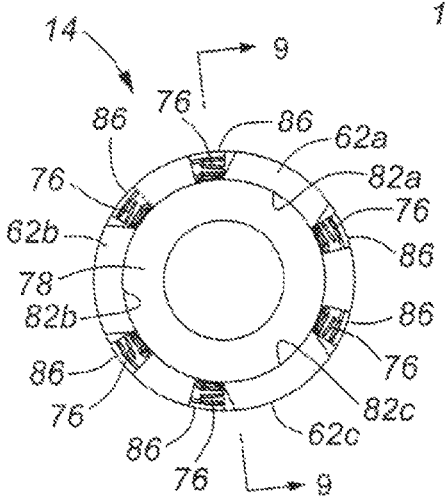
FIG. 8 is a cross-sectional view taken along lines 8-8 of the skate module shown in FIG. 6.
Figure 9:
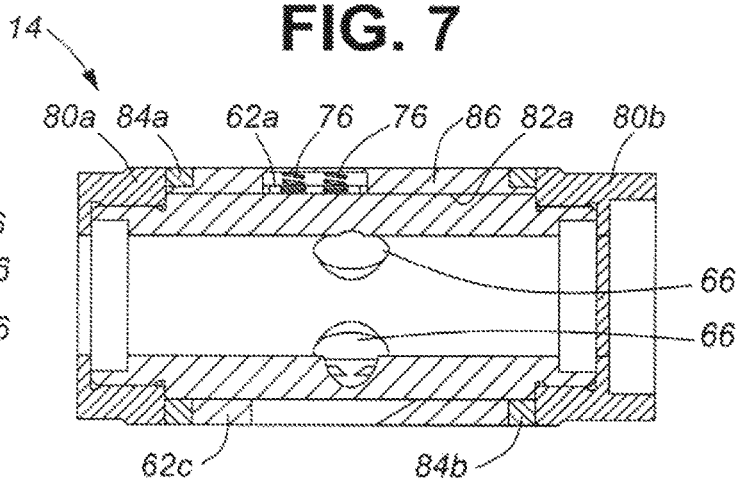
FIG. 9 is a cross-sectional view taken along lines 9-9 of the skate module shown in FIG. 8.

FIG. 7 is a cross-sectional view taken along lines 7-7 of the skate module 14 shown in FIG. 6. FIG. 8 is a cross-sectional view taken along lines 8-8 of the skate module 14 shown in FIG. 6. FIG. 9 is a cross-sectional view taken along lines 9-9 of the skate module shown in FIG. 8.

Figure 10:
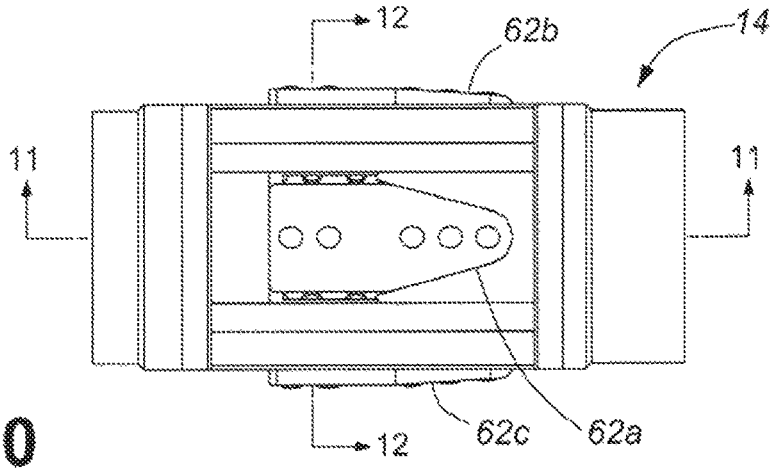
FIG. 10 is side elevational view of a skate module of the mechanical perforator shown in FIG. 6, with the guide skates in a deployed condition.

FIG. 10 is side elevational view of a skate module 14 of the mechanical perforator 10 shown in FIG. 6, with the guide skates 62*a*-62*c* in a deployed condition. The deployed condition of the guide skates 62*a*-62*c* is used to locate a mechanically perforated well casing collar 22 in a well casing string, and to lock the mechanical perforator 10 in position for perforating the mechanically perforated well casing collar 22, as will be explained below with reference to FIG. 16. As explained above, fluid pumped through the central passage 60 enters skate piston ports 66 and urges skate pistons 64 outwardly away from the central passage 60, urging the respective guide skates 62*a*-62*c* outwardly against the bias of the skate springs 76. All other parts and functions of the components of the skate module 14 were described above, and that description will not be repeated.

Figure 11:
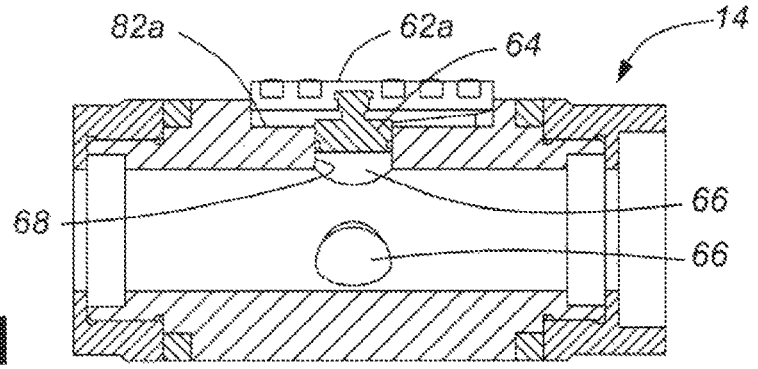
FIG. 11 is a cross-sectional view taken along lines 11-11 of the skate module shown in FIG. 10.
Figure 12:
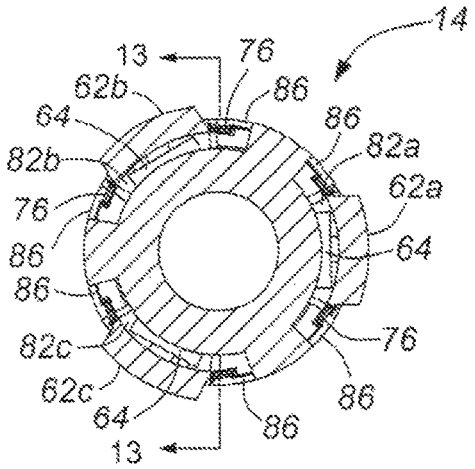
FIG. 12 is a cross-sectional view taken along lines 12-12 of the skate module shown in FIG. 10.
Figure 13:
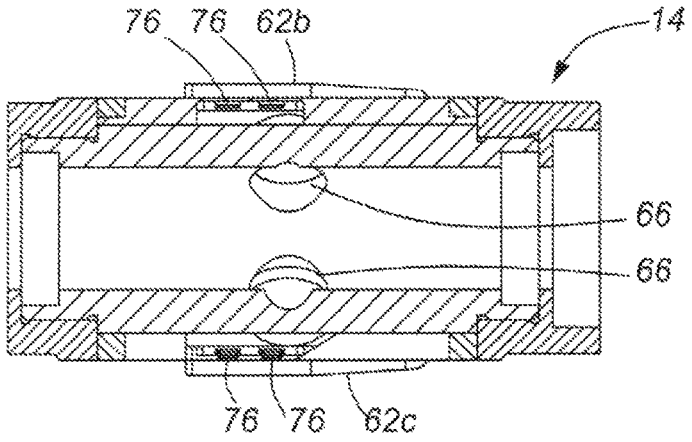
FIG. 13 is a cross-sectional view taken along lines 13-13 of the skate module shown in FIG. 12.

FIG. 11 is a cross-sectional view taken along lines 11-11 of the skate module 14 shown in FIG. 10. FIG. 12 is a cross-sectional view taken along lines 12-12 of the skate module 14 shown in FIG. 10. FIG. 13 is a cross-sectional view taken along lines 13-13 of the skate module shown in FIG. 12.

Figure 14:
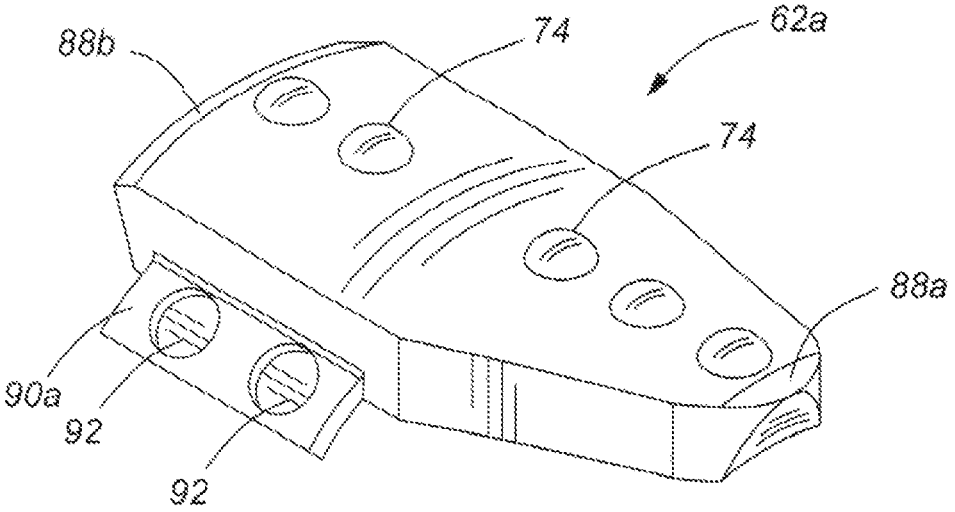
FIG. 14 is a perspective view of a top of a skate of the skate module shown in FIG. 6.

FIG. 14 is a perspective view of a top of the guide skate 62*a* of the skate module 14 shown in FIG. 6. In one embodiment the tops of the guide skates 62*a*, 62*b*, 62*c* have skate end bevels 88*a*, 88*b*. The skate end bevels 88*a*, 88*b* facilitate movement of the skate module 14 when the guide skates 62*a*-62*c* are in the deployed condition for locating a mechanically perforated casing collar 22. The guide skates 62*a*-62*c* also have skate side arms 90*a*, 90*b* with skate spring sockets 92 that receive and retain a bottom end of the skate springs 76.

Figure 15:
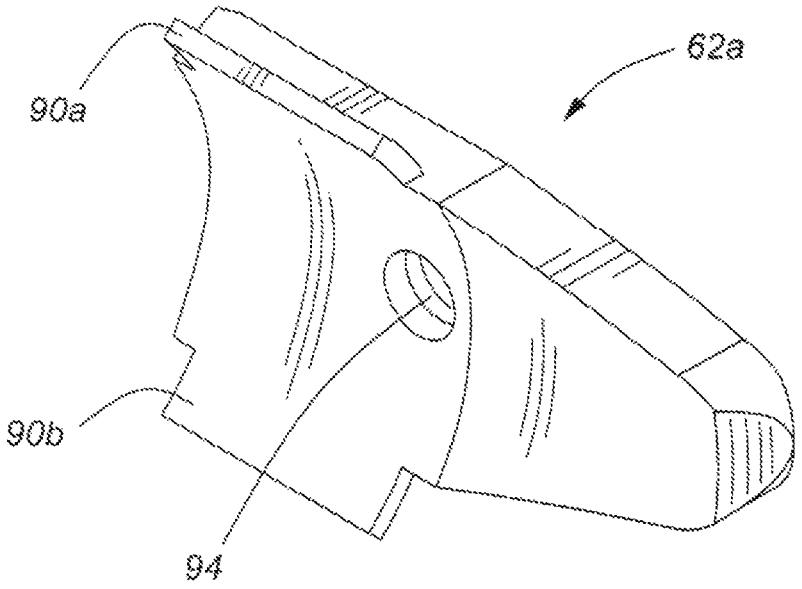
FIG. 15 is a perspective view of a bottom of the guide skate shown in FIG. 14.

FIG. 15 is a perspective view of a bottom surface of the guide skate 62*a* shown in FIG. 14. In one embodiment, the guide skates 62*a*-62*c* respectively include a skate piston rod socket 94 that receives and retains a piston rod of the skate piston 68.

Figure 16:
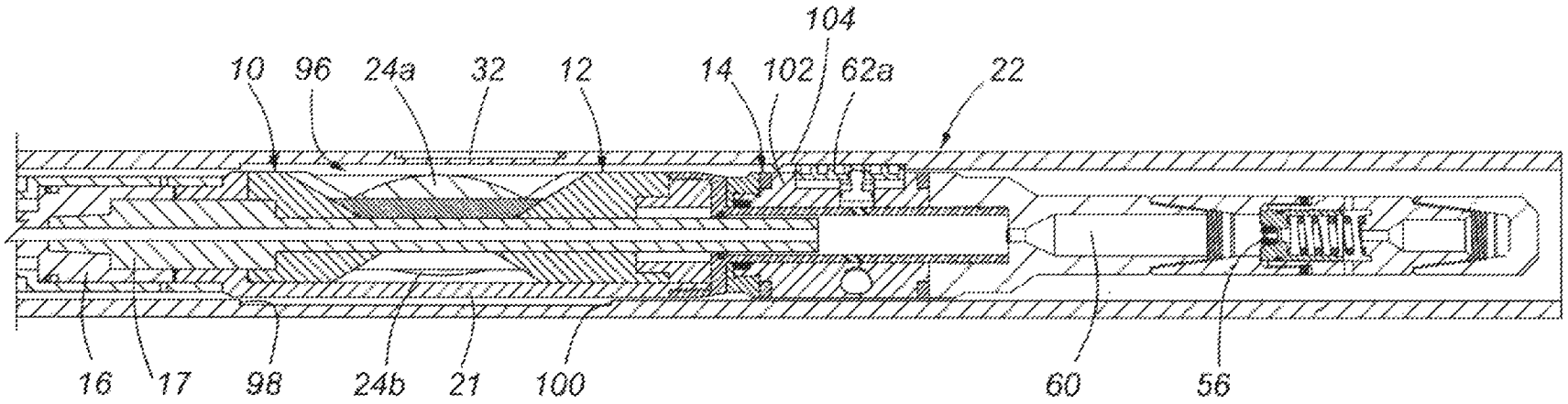
FIG. 16 is a cross-sectional view of the mechanical perforator shown in FIG. 2, locked in a mechanically perforated well casing collar ready to perforate the mechanically perforated well casing collar.

FIG. 16 is a cross-sectional view of the mechanical perforator 10 shown in FIG. 2, locked in a mechanically perforated well casing collar 22 ready to perforate the mechanically perforated well casing collar 22. In order to find this location in a well bore, which may be thousands of feet from the surface, fluid is pumped through the work string 20 into the central passage 60 at a pump rate (barrels per minute) that exceeds a rate of flow determined by a size of the orifice in the velocity bypass choke 56, which rapidly builds pressure in the central passage 60. To locate a mechanically perforated well casing collar 22, the fluid pressure in the central passage 60 is maintained at about 200-300 psi, which permits the guide skates 62*a*-62*c* to "skip" through a guide and lock structure 96 machined in an inner wall of mechanically perforated well casing collar 22 (as explained in Applicant's co-pending patent application entitled "Mechanically Perforated Well Casing Collar") when the mechanical perforator 10 is pulled uphole. The "skip" through the guide and lock structure 96 where passing over annular shoulder 98 registers a pronounced spike on a string weight gauge monitored by an operator of the work string 20 to inform the operator that the well casing collar 22 has been located. Pumped fluid pressure in the central passage 60 is then increased to around 2,000 psi and the work string is pushed back down the well bore. When the skate module drops into the guide and lock structure 96, the guide skates 62*a*-62*c* are urged by guide points 100 (only one is shown) into guide funnels (not shown) that direct the respective guide skates 62*a*-62*c* to respective skate lock recess shoulders 102 (only one is shown). Resistance when the skate module encounters the skate lock recess shoulders 102 registers as a large negative spike on the operator's string weight gauge, alerting the operator that the guide skates 62*a*-62*c* are in position to be pushed into respective skate lock recesses 104 (only one is shown). The respective skate lock recesses have right-angled ends which resist any further downhole movement of the work string so long as a high fluid pressure is maintained in the central passage 60.

When the respective guide skates 62*a*-62*c* are locked in their respective skate lock recesses 104, the respective perforator blades 24*a*-24*c* are aligned with respective machined-away areas 32 (only one is shown) and the linear force generator 16 may be operated to mechanically perforate the mechanically perforated well casing collar 22.

Figure 17:
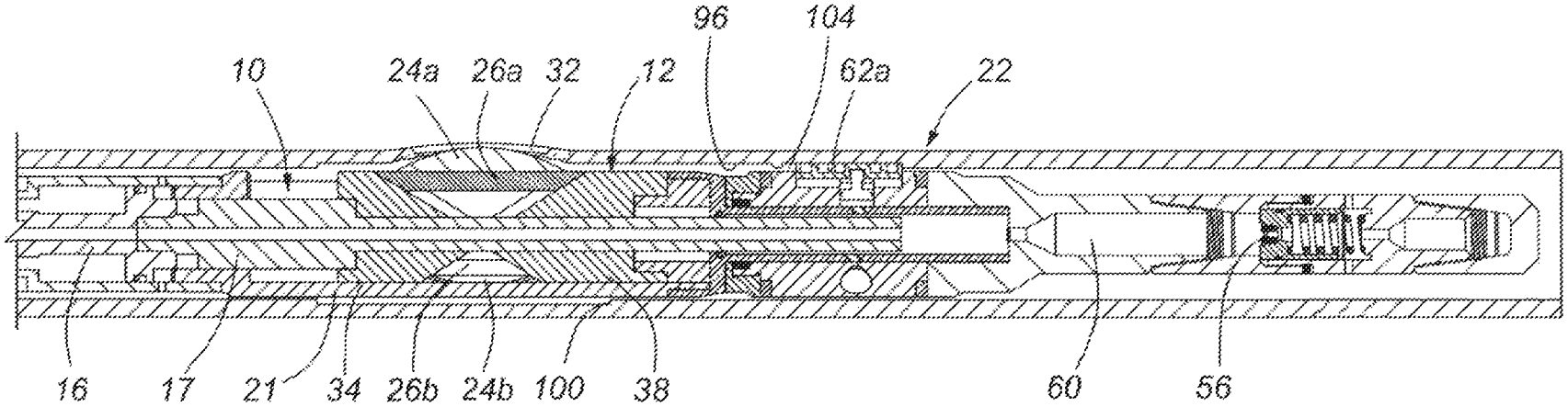
FIG. 17 is a cross-sectional view of the mechanical perforator shown in FIG. 2, after the mechanical perforator has perforated the mechanically perforated well casing collar.

FIG. 17 is a cross-sectional view of the mechanical perforator 10 shown in FIG. 2, after the mechanical perforator 10 has perforated the mechanically perforated well casing collar 22. Once the guide skates 62*a*-62*c* of the mechanical perforator 10 have been locked in respective skate lock recesses 104, the linear force generator 16 is operated to apply mechanical force against the perforator module 12, which urges the perforator end cone 34 downhole towards the perforator end cone 38, forcing the respective blade holders 26*a*-26*c* outwardly as they are forced upwardly over the respective upper perforator end cone 34 and lower perforator end cone 38. The upward slide of the respective blade holders 26*a*-26*c* moves the respective perforator blades 24*a*-24*c* into contact with the inner sidewall of the mechanically perforated well casing collar 22, coincident with respective machined-away areas 32. The advancing perforator blades 24*a*-24*c* tear the sidewall along the machined away areas 32 with little sidewall distortion, providing open slots through which high-pressure fracturing fluid may be pumped to stimulate a production formation in the area of the mechanically perforated well casing collar 22.

The embodiments of the invention described above are only exemplary of a construction of the mechanical perforator in accordance with the invention. The scope of the invention is therefore intended to be limited solely by the scope of the appended claims.

We claim:

1. A mechanical perforator for mechanically perforating a well casing collar having a sidewall with guide and lock structure on an internal surface thereof and at least one machined-away area to facilitate mechanical perforation thereof, the mechanical perforator comprising: at least one perforator blade adapted to mechanically perforate the at least one machined-away area; a linear force generator connected to the at least one perforator blade to provide linear force to drive the at least one perforator blade through the at least one machined-away area of the sidewall; and, a skate module having normally retracted guide skates adapted to be moved to a deployed condition and to cooperate with the guide and lock structure in the deployed condition, to guide the at least one perforator blade into alignment with the at least one machined-away area and releasably lock the at least one perforator blade in alignment with the at least one machined-away area the at least one perforator blade is supported within a perforator module having a perforator body that supports upper and tower perforator end cones that respectively support a perforator blade holder for each of the at least one perforator blade, the first perforator end cone being threadedly connected to a linear force generator mandrel of the linear force generator.

2. The mechanical perforator as claimed in claim 1 wherein the linear force generator mandrel extends through the lower perforator end cone and slideably supports the lower perforator end cone.

3. The mechanical perforator as claimed in claim 1 wherein the upper and lower perforator end cones respectively comprise a T-slot that respectively receive a T-slider on opposed ends of the at least one perforator blade holder.

4. The mechanical perforator as claimed in claim 3 wherein the at least one perforator blade holder comprises a perforator blade track having a perforator blade track end, the perforator blade track slideably receiving a respective one of the at least one perforator blade.

5. The mechanical perforator as claimed in claim 1 wherein the skate module is supported on a crossover body mandrel of a crossover body connected to a lower end of the perforator body.

6. The mechanical perforator as claimed in claim 1 wherein the skate module comprises a skate module body having at least one skate cavity that receives a one of the guide skates.

7. The mechanical perforator as claimed in claim 6 wherein the skate module further comprises a pair of skate retainer bars for each guide skate, each skate retainer bar being received in the skate cavity on a respective side of the guide skate.

8. The mechanical perforator as claimed in claim 7 further comprising skate springs located between the respective skate retainer bars and skate side arms of the guide skate, the skate springs urging the guide skate to the normally retracted position.

9. The mechanical perforator as claimed in claim 7 wherein the skate module further comprises a skate retainer ring received on each end of the skate module body, the skate retainer rings capturing opposed ends of the skate retainer bars.

10. The mechanical perforator as claimed in claim 9 wherein the skate module further comprises skate module end caps that threadedly engage opposed ends of the skate module body to retain the skate retainer rings.

11. A mechanical perforator for mechanically perforating a well casing collar having a sidewall with a guide and lock structure on an internal surface thereof and three machined-away areas to facilitate mechanical perforation thereof, the mechanical perforator comprising: a perforator module having three perforator blades adapted to mechanically perforate the respective machined-away areas of the sidewall; a linear force generator connected to one side of the perforator module to provide linear force to drive the three perforator blades of the perforator module through the respective machined-away areas of the sidewall; and, a skate module connected to an opposite side of the perforator module, the skate module having normally retracted guide skates adapted to be moved to a deployed condition and to cooperate with the guide and lock structure to guide each of the three blades of the perforator module into alignment with respective ones of three machined-away areas of the sidewall and releasably lock the three blades in respective alignment with the three machined-away areas of the sidewall; wherein the perforator module further comprises a perforator body that supports an upper perforator end cone threadedly connected to the linear force generator mandrel, and a lower perforator end cone that is supported on-a free end of a linear force generator mandrel, the respective upper and lower perforator end cones respectively having three equally spaced apart T-slots that respectively receive a T-slider on opposed ends of three perforator blade holders that respectively support one of the three perforator blades in a perforator blade track.

12. The mechanical perforator as claimed in claim 11 wherein the skate module comprises three guide skates normally urged to the retracted condition, each guide skate being connected to a skate piston that responds to fluid pressure to urge the respective guide skates to the deployed condition adapted to lock the three perforator blades in respective alignment with the three machined-away areas of the sidewall.

13. A mechanical perforator for mechanically perforating a well casing collar having a sidewall with a guide and lock structure on an internal surface thereof, the sidewall further having a plurality of machined-away areas to facilitate mechanical perforation of the sidewall, the mechanical perforator comprising a perforator module and a guide skate module, the perforator module having a plurality of perforator blades respectively adapted to perforate a one of the plurality of machined-away areas of the sidewall, and the guide skate module having normally retracted guides skates that are adapted to be urged to a deployed condition and further adapted to cooperate with the guide and lock structure to guide the respective perforator blades into alignment with respective ones of the machined-away areas and to releasably lock the perforator module in that alignment; a linear force generator connected to the perforator module, the linear force generator being adapted to urge the plurality of perforator blades through the respective ones of the machined-away areas of the sidewall, the linear force generator further-comprising a linear force generator mandrel with a free end, and the perforator module comprising a perforator body that supports an upper perforator end cone threadedly connected to the linear force generator mandrel and a lower perforator end cone supported on the linear force generator mandrel free end, the upper and lower perforator end cones respectively comprising a plurality of T-slots that respectively receive T-sliders on opposed ends of perforator blade holders that respectively support one of the plurality of perforator blades.

14. The mechanical perforator as claimed in claim 13 wherein the skate module comprises one guide skate for each of the plurality of perforator blades, the respective guide skates normally being urged to the retracted condition by springs.

15. The mechanical perforator as claimed in claim 14 further comprising skate pistons that reciprocate in skate piston chambers, the skate pistons being responsive to fluid pressure in a central passage of the mechanical perforator to urge the guide skates to the deployed condition in which the guide skates are adapted to cooperate with the guide and lock structure to guide the respective perforator blades into alignment with respective ones of the machined-away areas and releasably lock the perforator module in that alignment.

* * * * *